US006064295A

United States Patent [19]

Becher et al.

[11] Patent Number: 6,064,295

[45] Date of Patent: May 16, 2000

[54] TEMPERATURE-DEPENDENT SWITCH HAVING A BIMETALLIC SWITCHING MECHANISM

[75] Inventors: Michael Becher, Althengstett; Edwin Güttinger, Königsbach, both of Germany

[73] Assignee: Thermik Gerätebau GmbH, Pforzheim, Germany

[21] Appl. No.: 09/020,551

[22] Filed: Feb. 9, 1998

[30] Foreign Application Priority Data

Feb. 11, 1997 [DE] Germany ..... 197 05 154

[51] Int. Cl.[7] ..... H01H 37/04

[52] U.S. Cl. ..... 337/349; 337/342; 337/343

[58] Field of Search ..... 337/342, 343, 337/298, 333, 347, 348, 349, 354, 368, 53

[56] References Cited

U.S. PATENT DOCUMENTS

| | | | |
|---|---|---|---|
| 1,766,965 | 6/1930 | Thomas | 337/365 |
| 1,795,907 | 3/1931 | Thomas | 337/365 |
| 3,213,250 | 10/1965 | Marcoux | 337/365 |
| 3,305,655 | 2/1967 | Marcoux | 337/365 |
| 4,306,211 | 12/1981 | Hofsass | 337/89 |
| 4,470,033 | 9/1984 | Hofsass | 337/343 |
| 5,023,744 | 6/1991 | Hofsass | 361/26 |
| 5,428,336 | 6/1995 | Smith et al. | 337/365 |
| 5,867,084 | 2/1989 | Hofsäss . | |

FOREIGN PATENT DOCUMENTS

| | | |
|---|---|---|
| 0778599 | 6/1977 | European Pat. Off. . |
| 0313674 | 5/1989 | European Pat. Off. . |
| 2121802 | 1/1973 | Germany . |
| 3612251 | 10/1986 | Germany . |
| 8801497 | 8/1988 | Germany . |
| 01286221 | 11/1989 | Japan . |
| 1394612 | 5/1975 | United Kingdom . |
| WO 9220086 | 11/1992 | WIPO . |

*Primary Examiner*—Leo P. Picard
*Assistant Examiner*—Anatoly Vortman
*Attorney, Agent, or Firm*—Harness, Dickey & Pierce, P.L.C.

[57] ABSTRACT

A temperature-dependent switch (10) comprises a bimetallic switching mechanism (12) that is arranged in a housing (11) having a first housing part (14) made of insulating material and a second housing part (17). The bimetallic switching mechanism (12) is connected to a first electrode (16) that is guided out of one housing part (14), and coacts with a second electrode (19) that is provided internally on the other housing part (17). The bimetallic switching mechanism (12) comprises a spring element (23), working against a bimetallic disk (29), which carries a movable contact (28) that coacts with the second electrode (19). There is provided laterally on the spring element (23) a retaining extension piece (25) at which it is attached to the first electrode (16).

15 Claims, 2 Drawing Sheets

TEMPERATURE-DEPENDENT SWITCH HAVING A BIMETALLIC SWITCHING MECHANISM

BACKGROUND OF THE INVENTION

1. Field of the Invention

The present invention concerns a temperature-dependent switch having a bimetallic switching mechanism that is arranged in a housing having a first housing part and a second housing part, the bimetallic switching mechanism being connected to a first electrode that is guided out of one housing part and coacting with a second electrode that is provided internally on the other housing part.

2. Related Prior Art

A switch of this kind is known from WO 92/20086.

The known switch has a two-part housing made of insulating material, leading into each of whose opposing end faces is a stripped wire. A cavity, on whose bottom the one wire is arranged in a manner freely accessible from above, is provided in the interior of the housing.

A block on whose upper side the second wire ends is provided on the opposite end of the cavity, so that there is a difference in height between the two wire ends. A bimetallic switch tongue, which carries at its free end a movable contact which coacts with the end of the first wire, is attached at the end of the second wire. Depending on its temperature, the bimetallic switch tongue brings the movable contact into contact with the wire end or lifts it off therefrom.

The cover of the two-part housing is attached in hinged fashion to the lower part, and is intended to be welded by ultrasound to the lower part, thus achieving a tight seal with respect to the environment.

An advantage of the known switch is that it has small dimensions, and because of the insulating housing it has a low susceptibility to leakage currents but is not highly pressurestable. In addition, the air gaps in the interior of the housing are sufficiently large that the necessary insulating spacing is achieved.

Since the known switch is connected using leads, it can readily be processed further, but because the leads emerge from the housing at opposite ends, this switch is not well suited for automatic placement, since leads running parallel to one another are generally required in this context.

The known switch is associated with a whole series of further disadvantages, including principally the fact that current passes through the bimetallic switch tongue. The reason is that the electrical self-heating of the bimetallic switch tongue, which is in fact desirable here, influences the switching behavior in such a way that the switching temperature defined by the design of the bimetallic switch tongue can change as a function of current. In addition, the properties of the bimetallic switch tongue are influenced unpredictably by being welded onto the end of the second wire.

The known switch can therefore be used only to a limited extent for monitoring the temperature of a device being protected, since its switching temperature not only can change unpredictably as a result of the assembly operations, but also is influenced by the magnitude of the current that flows.

The known switch moreover has little contact reliability, because there are no geometrically reproducible contact conditions present between the bare wire end and the movable contact. This means that the contact surface depends in particular on the nature and magnitude of the curvature of the bimetallic switching tongue, which in turn is influenced in irreproducible fashion by mechanical stresses during welding and by the particular welding location itself. In addition, a special copper wire is necessary in order to provide resistance to abrasion.

A further disadvantage of the known switch consists in the fact that the housing is welded with ultrasound: the inventors of the present invention have recognized that in the case of the known switch, the use of ultrasound causes unpredictable changes in the switching behavior of the bimetallic switch tongue.

A further temperature-dependent switch that also has very small dimensions is known from DE-AS-2 121 802. This switch has a two-part metal housing made up of a lower part and a cover part insulated therefrom by means of an insulating film. The bimetallic switching mechanism consists in this case of a spring disk with a movable contact, and a bimetallic disk slipped over it.

The spring disk and the bimetallic disk are placed unconstrainedly into the lower part, i.e. are not subject to any mechanical loads. In the low-temperature position of the switching mechanism, the spring disk braces with its rim internally against the lower part, and presses the movable contact internally against the cover part, thus creating an electrically conductive connection between the lower part and the cover part. In this switch position, the bimetallic disk is completely unloaded.

When the temperature then rises above the changeover temperature of the bimetallic disk, it kicks over into its other configuration and then braces with its rim internally against the cover part, being electrically insulated with respect to the cover part by the interposed insulating film.

In its center region, the bimetallic disk now pushes the movable contact, against the force of the spring disk, away from the cover part and thereby opens the electrical connection between cover part and lower part.

With this switching mechanism, the predominating disadvantages present in the case of the switch known from WO 92/20086 do not exist. The bimetallic disk is not subject to any mechanical stresses when it is in its low-temperature position, and is furthermore not responsible for leading electrical current, so that no electrical self-heating occurs. On the other hand, the spring disk is responsible only for creating the electrical contact and taking over the current, so that the spring disk can be designed substantially with an eye to good current-leading properties. As a result, the electrical properties and the properties responsible for switching over as a function of temperature can, with this switch, be adjusted separately from one another; these properties moreover cannot be altered by assembly of the known switch.

This switch also has certain disadvantages, however, associated with the fact that it has a two-part metal housing. On the one hand, problems can occur during assembly of the known switch if the insulating film slips, so that the necessary insulation between lower part and cover part is not achieved, or the bimetallic disk is not sufficiently insulated, in its high-temperature position, with respect to the cover part. Particular problems occur here with leakage currents and with air gaps that are insufficient for insulation.

The housing of the known switch is furthermore not sufficiently sealed for certain applications: the cover part is held on the lower part merely by a crimped edge, and the insulating film provides sealing, which is nevertheless not always sufficient and may indeed be absent in the event of misassembly.

A further disadvantage of the admittedly very pressure-resistant metal housing consists in the fact that in many applications, it must still be insulated with respect to the device being protected. In the case of the known switch, the connection technology is such that crimp terminals are provided on both housing parts, to which terminals the connecting leads must then be attached by the user; because this cannot be automated, it is often also regarded as a disadvantage.

DE 43 37 141 A1 discloses a similarly configured switch which has the same advantages as the switch known from DE-AS-2 121 802. In this switch, however, the insulating film is adhesively bonded onto the cover part prior to assembly, so that the disadvantages associated with slippage of the insulating film are avoided.

This switch additionally has an external shoulder on the housing, on which sits one annular end of a connecting lug to whose other end a first connecting lead is soldered. The second connecting lead is soldered directly onto the cover part.

Although most of the aforementioned disadvantages have been eliminated with this switch, the technology for connecting the leads to the switch is nevertheless very complex, which is also regarded as a disadvantage. This switch moreover has relatively large dimensions.

It is a general disadvantage with both of the above-described switches having metal housings that the necessary protection from leakage currents and the necessary size of the air gaps is often not present for the connecting contacts, or has already been utilized to such an extent that the known switches cannot be further miniaturized.

SUMMARY OF THE INVENTION

In view of the above, it is an object of the present invention to provide for a switch of the type mentioned at the outset, having small dimensions, which combines the advantages of the switches discussed above and nevertheless eliminates their drawbacks; in particular, reproducible switching behavior is to be achieved along with simple construction and simple assembly.

According to the invention this object is achieved, in the case of the switch mentioned at the outset, by the fact that the bimetallic switching mechanism comprises a spring element, working against a bimetallic disk, which carries a movable contact that coacts with the second electrode; and that there is provided laterally on the spring element a retaining extension piece at which it is attached to the first electrode.

The object underlying the invention is completely achieved in this manner.

Specifically, the inventors of the present application have recognized that it is possible, in the case of a temperature-dependent switch having an insulating housing as well, to utilize a switching mechanism having a spring disk and a bimetallic disk working against the latter.

The entirely surprising manner in which the object underlying the invention is achieved now makes it possible to combine the advantages of the unconstrained bimetallic disk and the spring disk provided in order to carry current with a housing made of insulating material, in which the spacings between the electrodes, and above all their mutual insulation, are sufficient that the switch itself can be further miniaturized.

It is possible in this context for one housing part to be manufactured from metal, said part being retained by an elevated rim of the other housing part manufactured from insulating material, the rim being hot-pressed or hot-welded in order to ensure appropriate sealing.

It has been found that with switching mechanisms such as those used with the above-described switches having metal housings, the spring disk can be replaced by a spring element which has a retaining extension piece with which it is attached to the one electrode. This attachment provides not only electrical connection but also mechanical retention, which nevertheless does not disadvantageously impair the spring properties to such an extent as to degrade overall switching characteristics.

Principally important for the desired reproducible switching behavior is a bimetallic disk which is laid in unconstrainedly, and which is responsible not for carrying current but simply for temperature-dependent switching. In this fashion it is now also possible, with a switch having a housing made of insulating material, to adjust the properties of the bimetallic disk before it is assembled, so that assembly itself does not have any disadvantageous influence on said properties.

In a development, it is preferred if the second housing part is manufactured from insulating material and if the second electrode, which is connected from outside the housing, is arranged on its inner side.

The advantage here is that, as in the case of the generic switch, the housing is manufactured from insulating material, so that no further insulating actions are necessary when the new switch is mounted on a device being protected. A further advantage is that it is now possible to weld the two housing parts with ultrasound without causing irreproducible changes in switching behavior, since an unconstrained bimetallic disk is not influenced by ultrasound, as the inventors of the present application were able to determine. Moreover the two electrodes, which can be configured in planar fashion, impart good stability to the housing.

As a result, however, the new switch as so far described exhibits the advantages associated both with a tightly sealed housing made of insulating material, and with a bimetallic disk that is laid unconstrainedly in place and is not responsible for carrying current.

It is further preferred in this context if the spring element is configured as a spring disk with a retaining extension piece, which in its one switch position braces with its free rim region at least locally on a projecting shoulder which is provided in the first housing part.

The advantage here is that the shoulder forms, so to speak, a second buttress for the spring element, so that approximately the properties of an unconstrainedly laid-in spring disk can be achieved. The movable contact is now pressed in a defined alignment against the second electrode, resulting in good and reproducible contacting. The reason is that the spring element now operates not like a spring tongue clamped in at one end, as is the case with the generic switch with the bimetallic switch tongue used there, but like a spring disk having a protrusion. The protrusion, which hereinafter will also be referred to as a retaining extension piece, can be designed in such a way that, as before, the spring element has snap characteristics. Since the shoulder is configured in projecting fashion, meaning that empty space is still present below it, the spring element can moreover be pushed down by the bimetallic disk, resulting in mechanical conditions comparable to those in the switches discussed initially with metal housings.

It is preferred in this context if the bimetallic disk, in one of its switch positions, braces at its rim against a projecting shoulder that is provided in the second housing part.

The advantage here is that contact with the second electrode that is provided on the inner side of the second housing part is prevented in a simple manner. Since this shoulder is also configured in projecting fashion, a sufficient air gap moreover results between the second electrode and the rim of the bimetallic disk.

In a development, it is preferred if the second electrode is a sheet-metal part which is retained internally on the second housing part and to which is connected a connecting lead, leading outward, for which there is provided in the housing an insulation channel which preferably extends partly into the first and partly into the second housing part.

This feature is advantageous in particular in terms of simple assembly: half the insulation channel can, for example, be provided in each of the two housing parts. After assembly, the connecting lead then sits in the insulation channel surrounded on all sides by insulating material, thereby reliably eliminating leakage currents.

On the other hand, it is also preferred if the first electrode is a sheet-metal part which is retained internally on the first housing part and to which is connected a connecting lead, leading outward, for which there is provided in the housing an insulation channel which preferably extends partly into the first and partly into the second housing part.

The advantages associated with this feature are the same as with the insulation channel for the second electrode; the combination of the two insulation channels ensures particularly reliable insulation of the external terminals. The two sheetmetal parts moreover impart good pressure stability to the housing.

In a development, it is preferred in this context if the two insulation channels run parallel to one another on opposite outer sides of the housing, and terminate at one end face of the housing.

The advantage here is that a large spacing between the two connecting leads is achieved, as a result of which the available air gaps are determined not by the thickness but by the width of the housing, which is generally greater than the thickness. In other words, with this arrangement of the connecting leads and insulation channels, it is possible to implement a very flat switch in which the required lengths of the available air gaps can nevertheless be maintained. A further advantage is the fact that the two connecting leads are guided out of the housing next to one another, which is advantageous for later, in particular automatic, connecting technology.

It is preferred in general terms if both housing parts are manufactured substantially from solid material, in which geometrically adapted recesses are provided to receive the switching mechanism and the electrodes.

This feature results in the best possible insulation with respect to leakage currents, and a reduction in the number of air gaps, the particular arrangement of the insulation channels simultaneously ensuring large air spacings.

Lastly, it is also preferred if the two housing parts are joined to one another in swing-out fashion. The advantage here is that the new switch itself can be easily assembled. The two housing parts can be automatically fitted with the respective electrode, onto which the respective connecting lead is then soldered or welded. The spring element, the movable contact, and the bimetallic disk must then be placed into the one housing part; the spring element, optionally together with the associated electrode, can be secured in the housing part or welded to the electrode. The two housing parts are then folded together and welded to each other with ultrasound.

In summary, it may be stated that the new switch is thus easy to assemble, and assembly can occur automatically. The new switch moreover combines the advantages of the generic switch having an insulating housing with those of the known switch having a metal housing, although reliable and reproducible switching behavior is nevertheless achieved and minimal dimensions can be attained because of the good insulation in the interior of the switch.

Further features and advantages are evident from the description of the attached drawings.

It is understood that the features mentioned above and those yet to be explained below can be used not only in the respective combinations indicated, but also in other combinations or in isolation, without leaving the context of the present invention.

BRIEF DESCRIPTION OF THE DRAWINGS

An embodiment of the invention is depicted in the attached drawings and will be explained in more detail in the description below. In the drawings.

DETAILED DESCRIPTION OF A PREFERRED EMBODIMENT

Figure 1:
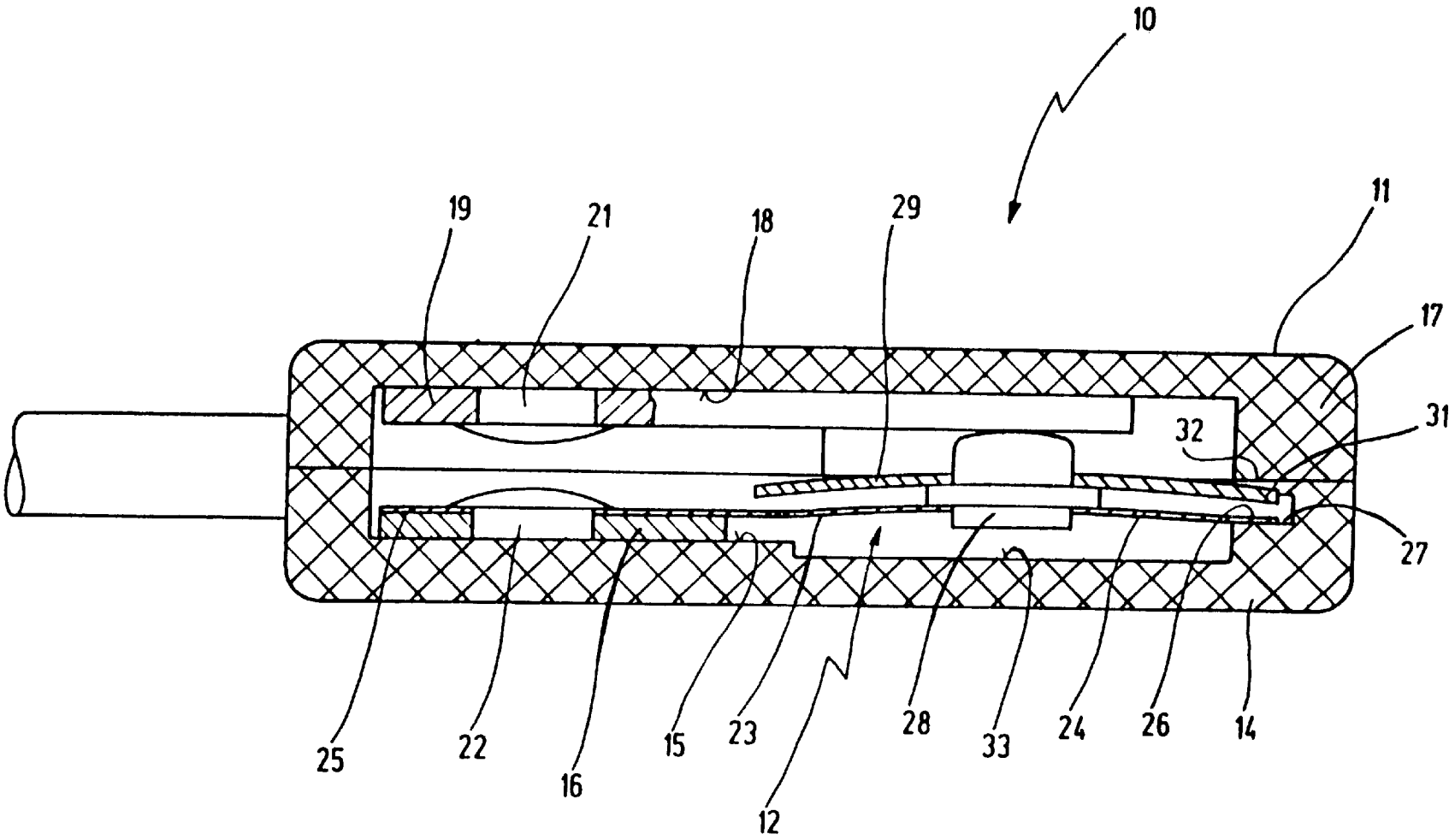
FIG. 1 shows a schematic sectioned depiction of the new switch, in a side view.

In FIG. 1, 10 designates a temperature-dependent switch that has a housing 11, manufactured from insulating material, in which a bimetallic switching mechanism 12 is arranged.

Housing 11 is configured in two parts and comprises a first housing part 14 on whose inner side 15 a first electrode 16 is arranged. Also provided is a second housing part 17 on whose inner side 18 a second electrode 19 is arranged.

Second electrode 19 is retained on housing part 17 by means of a pin 21, with first electrode 16 retained on housing part 14 by means of a pin 22.

Pin 22 also retains a spring element 23, which is a spring disk 24 having a retaining extension piece 25 configured integrally therewith, such that retaining extension piece 25 rests on first electrode 16 and is retained, together with the latter, by pin 22.

Spring disk 24 rests with its rim region 26, which is not occupied by retaining extension piece 25, on an internal projecting shoulder 27 that is arranged internally on first housing part 14.

Spring disk 24 carries, approximately centeredly, a movable contact 28 which it presses, in the switch position shown in FIG. 1, against second electrode 19.

A bimetallic disk 29, whose rim 31 is unloaded in the switch position shown, is slipped over movable contact 28. Associated with said rim 31, however, is a projecting shoulder 32 on second housing part 17.

In the switch position shown in FIG. 1, first and second electrodes 16, 19 are connected electrically to one another via movable contact 28 and spring element 23. The manner in which external connections are made to the new switch 10 will be explained later in conjunction with FIG. 2.

When the temperature in the new switch 10 is increased until the kickover temperature of bimetallic disk 29 is reached, the latter then snaps from its convex shape (as shown) into its concave shape, thereby bracing with its rim 31 against shoulder 32; at the same time, it lifts movable contact 28 off from second electrode 19, so that the electrical connection between the two electrodes 16, 19 is interrupted. Since shoulder 27 projects with respect to a bottom 33 of first housing part 14, imovable contact 28 can deflect downward, resulting in enough air spacing between movable contact 28 and first electrode 16 to ensure sufficient insulation.

Figure 2:
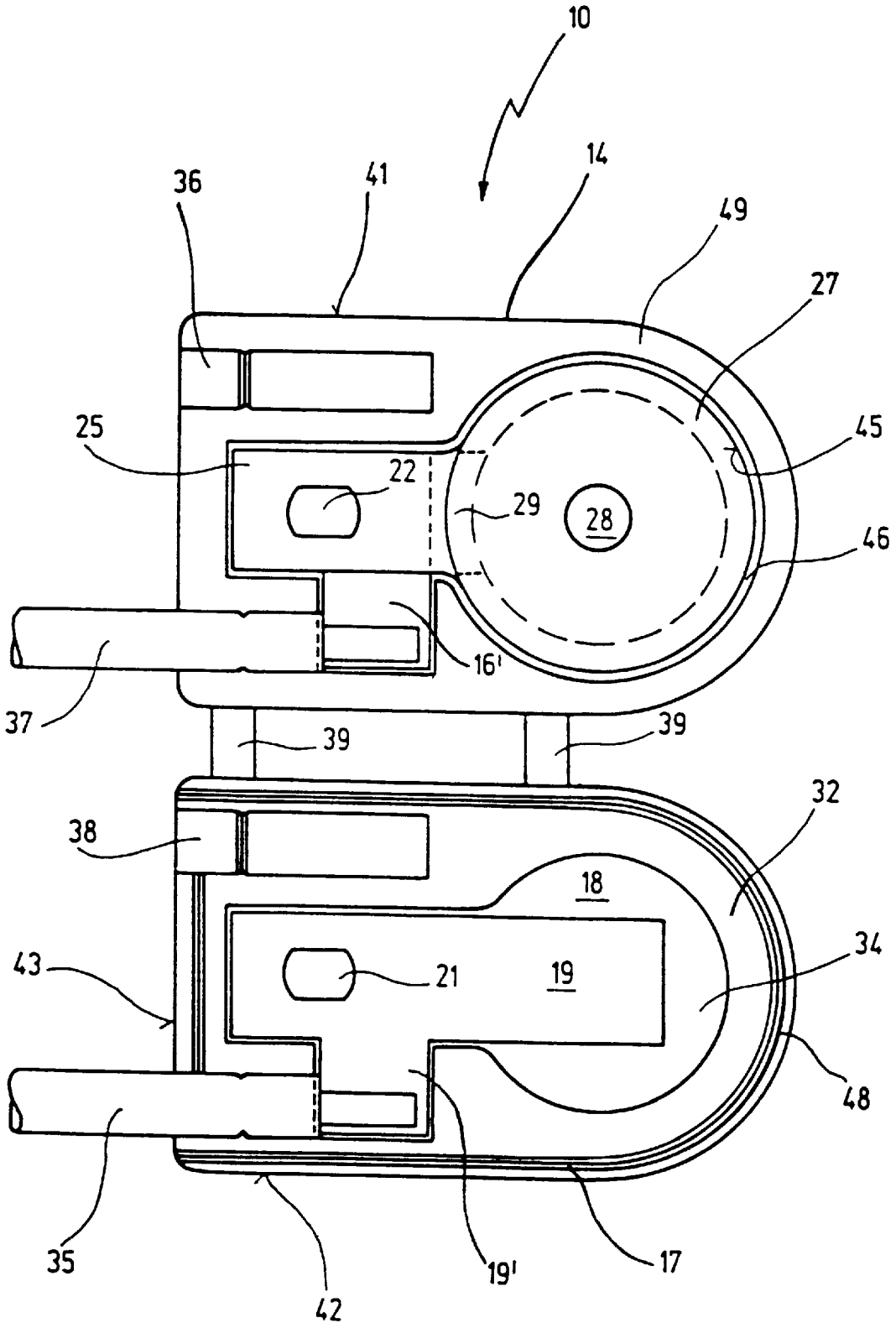
FIG. 2 shows a plan view of the new switch of FIG. 1, the housing parts being swung open but already populated.

In FIG. 2, the switch of FIG. 1 is shown shortly before completion of its assembly, with the two housing parts 14, 17 lying unfolded next to one another.

It is first of all apparent that there is provided in second housing part 17 a keyhole-like recess 34 on whose bottom, which corresponds to inner side 18, second electrode 19 is arranged, which has the shape of a T with an asymmetrically arranged crossbar. Soldered onto the downwardly projecting part 19' of second electrode 19 is a connecting lead 35 for which an insulation channel 36 is provided, half of which extends in the first and half in the second housing part 14, 17.

It is apparent at the top of FIG. 2 that first electrode 16 has an L-shape onto whose lower part 16' a connecting lead 37 is also soldered or welded. Connecting lead 37 extends in an insulation channel 38, half of which extends in each of the two housing parts 14, 17.

It is further apparent that the two housing parts 14, 17 are joined in fold-out fashion to one another by means of strips 39.

When housing part 17 is then folded onto housing part 14, the two connecting leads 35, 37 end up located entirely in the associated insulation channels 36, 38, which are now arranged, with a sufficient spacing from one another, on opposite outer sides 41, 42 of housing 11 but terminate at the same end face 43, so that connecting leads 35, 37 run parallel to one another on the same side of housing 11.

It is also apparent at the top of FIG. 2 that spring element 23 has a keyhole-like shape, its outer contour 45 partially coinciding with that of bimetallic disk 29. Shoulder 27 is also indicated with dashed lines.

First electrode 16 and spring element 23 are arranged in a recess 46 which also has approximately the shape of a keyhole, the L-shaped form of first electrode 16 also being taken into account in its region 16'.

Lastly, arranged at 48 is a profiled peripheral rim of second housing part 17 which, when the two housing parts 14, 17 are folded together, comes into contact with a corresponding peripheral rim 49 of first housing part 14 and can be welded thereto with ultrasound.

Returning to FIG. 1, it should additionally be noted that because of the thickness of first electrode 16, spring element 23 is retained at a certain distance from inner side 15 of housing part 14, thus leaving movable contact 28 sufficient room to deflect downward toward bottom 33. In this context, spring element 23 is guided almost completely along its periphery, so that it substantially has the snap characteristics of a spring disk as used in known switches having a metal housing.

It is also possible, of course, for connecting leads 35, 37 not to be welded to the respective electrodes 16, 19, but merely pressed on, which can be achieved by appropriate configuration of insulation channels 36, 38. In addition, spring element 23 can both be welded onto first electrode 16 and simply held thereon by means of a clamp connection. It is evident that because of their connection to electrodes 14, 19, connecting leads 35, 37 are responsible for the external connections of switch 10.

FIG. 2 shows the two housing parts 14, 17 as if they were manufactured from solid material, the corresponding geometrically adapted recesses 34, 46 being provided for electrodes 16, 19 and bimetallic switching mechanism 23, and insulation channels 36, 38 for connecting leads 35, 37. The many projecting webs in the two housing parts 14, 17 ensure very good insulation between the two connecting leads 35, 37 and the other electrically conducting parts in the new switch 10. Of course housing parts 14, 17 are not milled out of solid material, but rather appropriately cast or injection-molded.

It is possible, in this context, to injection-mold the two electrodes 16, 19 concurrently, so that they become an integral component of their respective housing parts 14 or 17.

Therefore, what I claim, is:

1. A temperature-dependent switch, comprising:

a housing having a first housing part made of insulating material, and a second housing part, a bimetallic switching mechanism arranged in said housing and including a spring element, a holding extension laterally provided at said spring element, a movable contact carried by said spring element, and a bimetallic disk;

a first electrode provided for external connection and arranged at one of said first and second housing parts;

a second electrode for external connection and provided at the other of said first and second housing parts, the second electrode being a sheet-metal part which is retained internally on the second housing part and to which is connected a connecting lead, leading outward, for which there is provided in the housing an insulation channel which extends partly into the first housing part and partly into the second housing part;

said spring element working against said bimetallic disk, said movable contact coacting with said second electrode, and said holding extension being attached to said first electrode.

2. A switch as in claim 1, wherein the first electrode is a sheet-metal part which is retained internally on the first housing part and to which is connected a connecting lead, leading outward, for which there is provided in the housing an insulation channel which preferably extends partly into the first housing part and partly into the second housing part.

3. A switch as in claim 2, wherein the two insulation channels run parallel to one another on opposite outer sides of the housing, and terminate at one end face of the housing.

4. A temperature-dependent switch, comprising:

a housing having a first housing part made of insulating material, and a second housing part, a bimetallic switching mechanism arranged in said housing and including a spring element, a holding extension laterally provided at said spring element, a movable contact carried by said spring element, and a bimetallic disk;

a first electrode provided for external connection and arranged at one of said first and second housing parts;

a second electrode for external connection and provided at the other of said first and second housing parts, said spring element working against said bimetallic disk, said movable contact coacting with said second electrode, and said holding extension being secured to said first electrode, wherein the second housing part is manufactured from insulating material and the second electrode is arranged on its inner side; and wherein the spring element is configured as a spring disk with a retaining extension piece, which in its one switch position braces with its free rim region at least locally on a projecting shoulder which is provided in the first housing part.

5. A temperature-dependent switch, comprising:

a housing having a first housing part made of insulating material, and a second housing part made of insulating material;

a bimetallic switching mechanism arranged in said housing and including a spring element configured as a spring disk with a lateral retaining extension piece, a movable contact carried by said spring element, and a bimetallic disk, said spring disk in one of its switch positions bracing with its free rim region at least locally on a projecting shoulder which is provided in the first housing part;

a first electrode provided for external connection and arranged at one of said first and second housing parts;

a second electrode for external connection and provided on the inner side of the other of said first and second housing parts, said spring element working against said bimetallic disk, said movable contact coacting with said second electrode, and said holding extension being mechanically secured to said first electrode.

6. A switch as in claim 5, wherein both housing parts are manufactured substantially from solid insulating material, in which geometrically adapted recesses are provided to receive the switching mechanism and the electrodes.

7. A switch as in claim 5, wherein the two housing parts are hinged to one another.

8. A temperature-dependent switch, comprising:

a housing having a first housing part made of insulating material, and a second housing part;

a bimetallic switching mechanism arranged in said housing and including a spring element, a holding extension laterally provided at said spring element, a movable contact carried by said spring element, and a bimetallic disk in one of its switch positions, bracing at its rim against a projecting shoulder that is provided in the second housing part;

a first electrode provided for external connection and arranged at one of said first and second housing parts;

a second electrode for external connection and provided at the other of said first and second housing parts, said spring element working against said bimetallic disk, said movable contact coacting with said second electrode, and said holding extension being mechanically secured to said first electrode.

9. A switch as in claim 8, wherein both housing parts are manufactured substantially from solid insulating material, in which geometrically adapted recesses are provided to receive the switching mechanism and the electrodes.

10. A switch as in claim 8, wherein the two housing parts are hinged to one another.

11. A temperature-dependent switch, comprising:

a housing having a first housing part made of insulating material, and a second housing part;

a bimetallic switching mechanism arranged in said housing and including a spring element, a holding extension laterally provided at said spring element, a movable contact carried by said spring element, and a bimetallic disk;

a first electrode provided for external connection and arranged at one of said first and second housing parts;

a second electrode for external connection and provided at the other of said first and second housing parts, said second electrode comprising a sheet-metal part which is retained internally on the other of said first and second housing parts and to which is connected a connecting lead, leading outward, for which there is provided in the housing an insulation channel which extends partly into the first and partly into the second housing part;

said spring element working against said bimetallic disk, said movable contact coacting with said second electrode, and said holding extension being mechanically secured to said first electrode.

12. A switch as in claim 11, wherein the first electrode is a sheet-metal part which is retained internally on the first housing part and to which is connected a connecting lead, leading outward, for which there is provided in the housing an insulation channel which extends partly into the first housing part and partly into the second housing part.

13. A switch as in claim 12, wherein the two insulation channels run parallel to one another on opposite outer sides of the housing, and terminate at one end face of the housing.

14. A switch as in claim 11, wherein both housing parts are manufactured substantially from solid insulating material, in which geometrically adapted recesses are provided to receive the switching mechanism and the electrodes.

15. A switch as in claim 11, wherein the two housing parts are hinged to one another.

* * * * *